US008948345B2

(12) United States Patent
Wang

(10) Patent No.: US 8,948,345 B2
(45) Date of Patent: Feb. 3, 2015

(54) X-RAY TUBE HIGH VOLTAGE SENSING RESISTOR

(71) Applicant: Moxtek, Inc., Orem, UT (US)

(72) Inventor: Dongbing Wang, Lathrop, CA (US)

(73) Assignee: Moxtek, Inc., Orem, UT (US)

( * ) Notice: Subject to any disclaimer, the term of this patent is extended or adjusted under 35 U.S.C. 154(b) by 186 days.

(21) Appl. No.: 13/744,193

(22) Filed: Jan. 17, 2013

(65) Prior Publication Data

US 2013/0136237 A1 May 30, 2013

Related U.S. Application Data

(63) Continuation of application No. PCT/US2011/044168, filed on Jul. 15, 2011, which is a continuation of application No. 12/890,325, filed on Sep. 24, 2010, now Pat. No. 8,526,574.

(60) Provisional application No. 61/610,018, filed on Mar. 13, 2012, provisional application No. 61/420,401, filed on Dec. 7, 2010.

(51) Int. Cl.

| | |
|---|---|
| ***H05G 1/26*** | (2006.01) |
| ***H05G 1/08*** | (2006.01) |
| ***H01J 35/02*** | (2006.01) |
| ***H05G 1/12*** | (2006.01) |

(52) U.S. Cl.

CPC ..... *H05G 1/265* (2013.01); *H05G 1/08* (2013.01); *H05G 1/12* (2013.01)

USPC ..... 378/121; 378/91

(58) Field of Classification Search

CPC ..... H05G 1/08; H05G 1/265; H01J 35/16

USPC ..... 378/91, 117, 118, 121

See application file for complete search history.

(56) References Cited

U.S. PATENT DOCUMENTS

| | | | |
|---|---|---|---|
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

Barkan et al., "Improved window for low-energy x-ray transmission a Hybrid design for energy-dispersive microanalysis," Sep. 1995, 2 pages, Ectroscopy 10(7).

(Continued)

*Primary Examiner* — Allen C. Ho

(74) *Attorney, Agent, or Firm* — Thorpe North & Western LLP

(57) ABSTRACT

A high voltage sensing resistor disposed on a cylinder that at least partially surrounds an evacuated enclosure of an x-ray tube.

20 Claims, 3 Drawing Sheets

(56) References Cited

U.S. PATENT DOCUMENTS

| | | | |
|---|---|---|---|
| 2,952,790 | A | 9/1960 | Steen |
| 3,356,559 | A | 12/1967 | Mohn et al. |
| 3,397,337 | A | 8/1968 | Denholm |
| 3,434,062 | A | 3/1969 | Cox |
| 3,665,236 | A | 5/1972 | Gaines et al. |
| 3,679,927 | A | 7/1972 | Kirkendall |
| 3,691,417 | A | 9/1972 | Gralenski |
| 3,741,797 | A | 6/1973 | Chavasse, Jr. et al. |
| 3,751,701 | A | 8/1973 | Gralenski et al. |
| 3,801,847 | A | 4/1974 | Dietz |
| 3,828,190 | A | 8/1974 | Dahlin et al. |
| 3,851,266 | A | 11/1974 | Conway |
| 3,872,287 | A | 3/1975 | Kooman |
| 3,882,339 | A | 5/1975 | Rate et al. |
| 3,894,219 | A | 7/1975 | Weigel |
| 3,962,583 | A | 6/1976 | Holland et al. |
| 3,970,884 | A | 7/1976 | Golden |
| 4,007,375 | A | 2/1977 | Albert |
| 4,075,526 | A | 2/1978 | Grubis |
| 4,160,311 | A | 7/1979 | Ronde et al. |
| 4,163,900 | A | 8/1979 | Warren et al. |
| 4,178,509 | A | 12/1979 | More et al. |
| 4,184,097 | A | 1/1980 | Auge |
| 4,250,127 | A | 2/1981 | Warren et al. |
| 4,293,373 | A | 10/1981 | Greenwood |
| 4,368,538 | A | 1/1983 | McCorkle |
| 4,393,127 | A | 7/1983 | Greschner et al. |
| 4,400,822 | A | 8/1983 | Kuhnke et al. |
| 4,421,986 | A | 12/1983 | Friauf et al. |
| 4,443,293 | A | 4/1984 | Mallon et al. |
| 4,463,338 | A | 7/1984 | Utner et al. |
| 4,504,895 | A | 3/1985 | Steigerwald |
| 4,521,902 | A | 6/1985 | Peugeot |
| 4,532,150 | A | 7/1985 | Endo et al. |
| 4,573,186 | A | 2/1986 | Reinhold |
| 4,576,679 | A | 3/1986 | White |
| 4,591,756 | A | 5/1986 | Avnery |
| 4,608,326 | A | 8/1986 | Neukermans et al. |
| 4,675,525 | A | 6/1987 | Amingual et al. |
| 4,679,219 | A | 7/1987 | Ozaki |
| 4,688,241 | A | 8/1987 | Peugeot |
| 4,705,540 | A | 11/1987 | Hayes |
| 4,734,924 | A | 3/1988 | Yahata et al. |
| 4,761,804 | A | 8/1988 | Yahata |
| 4,777,642 | A | 10/1988 | Ono |
| 4,797,907 | A | 1/1989 | Anderton |
| 4,818,806 | A | 4/1989 | Kunimune et al. |
| 4,819,260 | A | 4/1989 | Haberrecker |
| 4,862,490 | A | 8/1989 | Karnezos et al. |
| 4,870,671 | A | 9/1989 | Hershyn |
| 4,876,330 | A | 10/1989 | Higashi et al. |
| 4,878,866 | A | 11/1989 | Mori et al. |
| 4,885,055 | A | 12/1989 | Woodbury et al. |
| 4,891,831 | A | 1/1990 | Tanaka et al. |
| 4,933,557 | A | 6/1990 | Perkins |
| 4,939,763 | A | 7/1990 | Pinneo et al. |
| 4,957,773 | A | 9/1990 | Spencer et al. |
| 4,960,486 | A | 10/1990 | Perkins et al. |
| 4,969,173 | A | 11/1990 | Valkonet |
| 4,979,198 | A | 12/1990 | Malcolm et al. |
| 4,979,199 | A | 12/1990 | Cueman et al. |
| 4,995,069 | A | 2/1991 | Tanaka |
| 5,010,562 | A | 4/1991 | Hernandez et al. |
| 5,063,324 | A | 11/1991 | Grunwald et al. |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,178,140 | A | 1/1993 | Ibrahim |
| 5,187,737 | A | 2/1993 | Watanabe |
| 5,196,283 | A | 3/1993 | Ikeda et al. |
| 5,200,984 | A | 4/1993 | Laeuffer |
| 5,217,817 | A | 6/1993 | Verspui et al. |
| 5,226,067 | A | 7/1993 | Allred et al. |
| RE34,421 | E | 10/1993 | Parker et al. |
| 5,258,091 | A | 11/1993 | Imai et al. |
| 5,267,294 | A | 11/1993 | Kuroda et al. |
| 5,343,112 | A | 8/1994 | Wegmann |
| 5,347,571 | A | 9/1994 | Furbee et al. |
| 5,391,958 | A | 2/1995 | Kelly |
| 5,392,042 | A | 2/1995 | Pellon |
| 5,400,385 | A | 3/1995 | Blake et al. |
| 5,422,926 | A | 6/1995 | Smith et al. |
| 5,428,658 | A | 6/1995 | Oettinger et al. |
| 5,432,003 | A | 7/1995 | Plano et al. |
| 5,469,429 | A | 11/1995 | Yamazaki et al. |
| 5,469,490 | A | 11/1995 | Golden et al. |
| 5,478,266 | A | 12/1995 | Kelly |
| 5,521,851 | A | 5/1996 | Wei et al. |
| 5,524,133 | A | 6/1996 | Neale et al. |
| RE35,383 | E | 11/1996 | Miller et al. |
| 5,571,616 | A | 11/1996 | Phillips et al. |
| 5,578,360 | A | 11/1996 | Viitanen |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,673,044 | A | 9/1997 | Pellon |
| 5,680,433 | A | 10/1997 | Jensen |
| 5,682,412 | A | 10/1997 | Skillicorn et al. |
| 5,696,808 | A | 12/1997 | Lenz |
| 5,706,354 | A | 1/1998 | Stroehlein |
| 5,729,583 | A | 3/1998 | Tang et al. |
| 5,774,522 | A | 6/1998 | Warburton |
| 5,812,632 | A | 9/1998 | Schardt et al. |
| 5,835,561 | A | 11/1998 | Moorman et al. |
| 5,870,051 | A | 2/1999 | Warburton |
| 5,898,754 | A | 4/1999 | Gorzen |
| 5,907,595 | A | 5/1999 | Sommerer |
| 5,978,446 | A | 11/1999 | Resnick |
| 6,002,202 | A | 12/1999 | Meyer et al. |
| 6,005,918 | A | 12/1999 | Harris et al. |
| 6,044,130 | A | 3/2000 | Inazura et al. |
| 6,062,931 | A | 5/2000 | Chuang et al. |
| 6,069,278 | A | 5/2000 | Chuang |
| 6,073,484 | A | 6/2000 | Miller et al. |
| 6,075,839 | A | 6/2000 | Treseder |
| 6,097,790 | A | 8/2000 | Hasegawa et al. |
| 6,129,901 | A | 10/2000 | Moskovits et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,388,359 | B1 | 5/2002 | Duelli et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,644,853 | B1 * | 11/2003 | Kantor et al. ..... 378/203 |
| 6,645,757 | B1 | 11/2003 | Okandan et al. |
| 6,646,366 | B2 | 11/2003 | Hell et al. |
| 6,658,085 | B2 | 12/2003 | Sklebitz et al. |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,803,571 | B1 | 10/2004 | Mankos et al. |
| 6,816,573 | B2 | 11/2004 | Hirano et al. |

(56) References Cited

U.S. PATENT DOCUMENTS

| | | | | |
|---|---|---|---|---|
| 6,819,741 | B2 | 11/2004 | Chidester | |
| 6,852,365 | B2 | 2/2005 | Smart et al. | |
| 6,866,801 | B1 | 3/2005 | Mau et al. | |
| 6,876,724 | B2 | 4/2005 | Zhou | |
| 6,944,268 | B2 * | 9/2005 | Shimono | 378/111 |
| 6,956,706 | B2 | 10/2005 | Brandon | |
| 6,976,953 | B1 | 12/2005 | Pelc | |
| 6,987,835 | B2 | 1/2006 | Lovoi | |
| 7,035,379 | B2 | 4/2006 | Turner et al. | |
| 7,046,767 | B2 | 5/2006 | Okada et al. | |
| 7,049,735 | B2 | 5/2006 | Ohkubo et al. | |
| 7,050,539 | B2 | 5/2006 | Loef et al. | |
| 7,072,439 | B2 * | 7/2006 | Radley et al. | 378/47 |
| 7,075,699 | B2 | 7/2006 | Oldham et al. | |
| 7,085,354 | B2 | 8/2006 | Kanagami | |
| 7,108,841 | B2 | 9/2006 | Smalley | |
| 7,110,498 | B2 | 9/2006 | Yamada | |
| 7,130,380 | B2 | 10/2006 | Lovoi et al. | |
| 7,130,381 | B2 | 10/2006 | Lovoi et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,233,647 | B2 | 6/2007 | Turner et al. | |
| 7,236,568 | B2 * | 6/2007 | Dinsmore et al. | 378/139 |
| 7,286,642 | B2 | 10/2007 | Ishikawa et al. | |
| 7,305,066 | B2 | 12/2007 | Ukita | |
| 7,317,784 | B2 | 1/2008 | Durst et al. | |
| 7,358,593 | B2 | 4/2008 | Smith et al. | |
| 7,382,862 | B2 | 6/2008 | Bard et al. | |
| 7,399,794 | B2 | 7/2008 | Harmon et al. | |
| 7,410,601 | B2 | 8/2008 | Sato et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,486,774 | B2 | 2/2009 | Cain | |
| 7,526,068 | B2 | 4/2009 | Dinsmore | |
| 7,529,345 | B2 | 5/2009 | Bard et al. | |
| 7,618,906 | B2 | 11/2009 | Meilahti | |
| 7,634,052 | B2 | 12/2009 | Grodzins et al. | |
| 7,649,980 | B2 | 1/2010 | Aoki et al. | |
| 7,650,050 | B2 | 1/2010 | Haffner et al. | |
| 7,657,002 | B2 | 2/2010 | Burke et al. | |
| 7,675,444 | B1 | 3/2010 | Smith et al. | |
| 7,680,652 | B2 | 3/2010 | Giesbrecht et al. | |
| 7,693,265 | B2 | 4/2010 | Hauttmann et al. | |
| 7,709,820 | B2 | 5/2010 | Decker et al. | |
| 7,737,424 | B2 | 6/2010 | Xu et al. | |
| 7,756,251 | B2 | 7/2010 | Davis et al. | |
| 7,983,394 | B2 | 7/2011 | Kozaczek et al. | |
| 8,498,381 | B2 | 7/2013 | Liddiard | |
| 8,761,344 | B2 * | 6/2014 | Reynolds et al. | 378/138 |
| 8,774,365 | B2 * | 7/2014 | Wang | 378/111 |
| 8,804,910 | B1 * | 8/2014 | Wang et al. | 378/101 |
| 2002/0075999 | A1 | 6/2002 | Rother | |
| 2002/0094064 | A1 | 7/2002 | Zhou | |
| 2003/0096104 | A1 | 5/2003 | Tobita et al. | |
| 2003/0152700 | A1 | 8/2003 | Asmussen et al. | |
| 2003/0165418 | A1 | 9/2003 | Ajayan et al. | |
| 2004/0076260 | A1 | 4/2004 | Charles, Jr. et al. | |
| 2005/0018817 | A1 | 1/2005 | Oettinger et al. | |
| 2005/0036939 | A1 | 2/2005 | Wong et al. | |
| 2005/0141669 | A1 | 6/2005 | Shimono et al. | |
| 2005/0207537 | A1 | 9/2005 | Ukita | |
| 2006/0073682 | A1 | 4/2006 | Furukawa et al. | |
| 2006/0098778 | A1 | 5/2006 | Oettinger et al. | |
| 2006/0210020 | A1 | 9/2006 | Takahshi et al. | |
| 2006/0233307 | A1 | 10/2006 | Dinsmore | |
| 2006/0269048 | A1 | 11/2006 | Cain | |
| 2006/0280289 | A1 | 12/2006 | Hanington et al. | |
| 2007/0025516 | A1 | 2/2007 | Bard et al. | |
| 2007/0111617 | A1 | 5/2007 | Meilahti | |
| 2007/0165780 | A1 | 7/2007 | Durst et al. | |
| 2007/1072104 | | 7/2007 | Nishide | |
| 2007/0183576 | A1 | 8/2007 | Burke et al. | |
| 2007/0217574 | A1 | 9/2007 | Beyerlein | |
| 2008/0199399 | A1 | 8/2008 | Chen et al. | |
| 2008/0296479 | A1 | 12/2008 | Anderson et al. | |
| 2008/0296518 | A1 | 12/2008 | Xu et al. | |
| 2008/0317982 | A1 | 12/2008 | Hecht | |
| 2009/0085426 | A1 | 4/2009 | Davis et al. | |
| 2009/0086923 | A1 | 4/2009 | Davis et al. | |
| 2009/0213914 | A1 | 8/2009 | Dong et al. | |
| 2009/0243028 | A1 | 10/2009 | Dong et al. | |
| 2010/0098216 | A1 | 4/2010 | Dobson | |
| 2010/0126660 | A1 | 5/2010 | O'Hara | |
| 2010/0140497 | A1 | 6/2010 | Damiano, Jr. et al. | |
| 2010/0189225 | A1 | 7/2010 | Ernest et al. | |
| 2010/0239828 | A1 | 9/2010 | Cronaby et al. | |
| 2010/0243895 | A1 | 9/2010 | Xu et al. | |
| 2010/0285271 | A1 | 11/2010 | Davis et al. | |
| 2011/0121179 | A1 | 5/2011 | Liddiard et al. | |
| 2012/0025110 | A1 | 2/2012 | Davis et al. | |
| 2012/0076276 | A1 | 3/2012 | Wang et al. | |
| 2012/0087476 | A1 | 4/2012 | Liddiard et al. | |
| 2013/0077758 | A1 | 3/2013 | Miller | |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57 082954 | 8/1982 |
| JP | 3170673 | 7/1991 |
| JP | 4171700 | 6/1992 |
| JP | 05066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 2003/007237 | 1/2003 |
| JP | 2003/088383 | 3/2003 |
| JP | 2003510236 | 3/2003 |
| JP | 2003211396 | 7/2003 |
| JP | 2006297549 | 11/2006 |
| KR | 1020050107094 | 11/2005 |
| WO | WO 99/65821 | 12/1999 |
| WO | WO 00/17102 | 3/2000 |
| WO | WO 03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |
| WO | WO 2012/039823 | 3/2012 |

OTHER PUBLICATIONS

Blanquart et al.; "XPAD, a New Read-out Pixel Chip for X-ray Counting"; IEEE Xplore; Mar. 25, 2009.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).

http://www.orau.org/ptp/collectio/xraytubescollidge/MachlettCW250T.htm, 1999, 2 pages.

Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).

(56) References Cited

OTHER PUBLICATIONS

Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).
Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Michaelidis, M., and R. Pollard, "Analysis of chemical vapor deposition of boron," J. Electrochem. Soc. 132, 1757 (1985).
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Nakamura, K., "Preparation and properties of amorphous boron nitride films by molecular flow chemical vapor deposition," J. Electrochem. Soc. 132, 1757 (1985).
Panayiotatos, et al., "Mechanical performance and growth characteristics of boron nitride films with respect to their optical, compositional properties and density," Surface and Coatings Technology, 151-152 (2002) 155-159.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Rankov et al., "A novel correlated double sampling poly-Si circuit for readout systems in large area x-ray sensors", IEEE, May 2005, 728-731, vol. 1.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No. 5, Oct. 2005.
Tien-Hui Lin et al., "An investigation on the films used as the windows of ultra-soft X-ray counters." Acta Physica Sinica, vol. 27, No. 3, pp. 276-283, May 1978, abstract only.
U.S. Appl. No. 13/307,579, filed Nov. 30, 2011; Dongbing Wang.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek,com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May 2007, 2 pages.
www.moxtek.com, Moxtek, ProLine Series 10 Windows, Ultra-thin Polymer X-Ray Windows, Sep. 6, 2012.
www.moxtek.com, X-Ray Windows, ProLINE Series 20 Windows Ultra-thin Polymer X-ray Windows, 2 pages. Applicant believes that this product was offered for sale prior to the filing date of applicant's application.

* cited by examiner

X-RAY TUBE HIGH VOLTAGE SENSING RESISTOR

CLAIM OF PRIORITY

Priority is claimed to U.S. Provisional Patent Application Ser. No. 61/610,018, filed on Mar. 13, 2012; which is hereby incorporated herein by reference in its entirety.

This is a continuation-in-part of International Patent Application Serial Number PCT/US2011/044168, filed on Jul. 15, 2011; which claims priority to U.S. patent application Ser. No. 12/890,325, filed Sep. 24, 2012 (now U.S. Pat. No. 8,526,574, issued on Sep. 3, 2013), and U.S. Provisional Patent Application Ser. No. 61/420,401, filed Dec. 7, 2010; which are hereby incorporated herein by reference in their entirety.

BACKGROUND

A desirable characteristic of x-ray sources, especially portable x-ray sources, is small size. An x-ray source can be comprised of an x-ray tube and a power supply. An x-ray source can have a high voltage sensing resistor used in the power supply circuit for sensing the tube voltage. The high voltage sensing resistor, due to a very high voltage across the x-ray tube, such as around 10 to 200 kilovolts, can require a very high resistance, such as around 10 mega ohms to 100 giga ohms for example. The high voltage sensing resistor can be a surface mount resistor and can be relatively large compared to other resistors. For example, resistor dimension can be around 12 mm×50 mm×1 mm in some power supplies. Especially in miniature and portable x-ray tubes, the size of this resistor can be an undesirable limiting factor in reduction of size of a power supply for these x-ray tubes.

SUMMARY

It has been recognized that it would be advantageous to have a smaller, more compact, x-ray source. The present invention is directed towards a smaller, more compact, x-ray source.

To save space, the high voltage sensing resistor can be disposed over an x-ray tube cylinder. Thus by having the high voltage sensing resistor over the x-ray tube cylinder, space required by this resistor can be minimized, allowing for a more compact power supply of the x-ray source.

A method for sensing a voltage V across an x-ray tube can comprise painting electrically insulative material on a surface of an electrically insulative cylinder, the insulative material comprising a first resistor R1, the insulative cylinder surrounding at least a portion of an evacuated chamber of an x-ray tube. The first resistor R1 can be connected to a second resistor R2 at one end and to either a cathode or an anode of the x-ray tube at an opposing end. A voltage V2 across the second resistor R2 can be measured. A voltage V across the x-ray tube can be calculated by $$V = \frac{V_2 * (r_1 + r_2)}{r_2},$$

V is a voltage across the x-ray tube, V2 is a voltage across the second resistor R2, r1 is a resistance of the first resistor R1, and r2 is a resistance of the second resistor R2.

DEFINITIONS

As used herein, the term "evacuated chamber" means an enclosure having a sufficiently high internal vacuum to allow operation as an x-ray tube.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Figure 1:
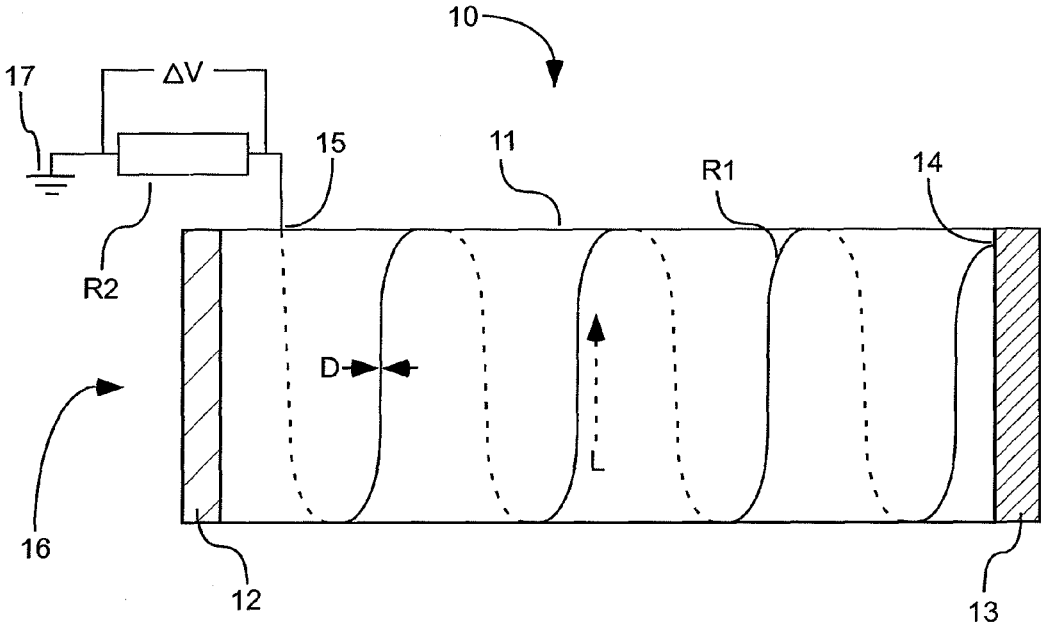
FIG. 1 is a schematic cross-sectional side view of an electrically insulative cylinder with a first resistor disposed on or over a surface of the cylinder, and circumscribing the cylinder, in accordance with an embodiment of the present invention.
Figure 2:
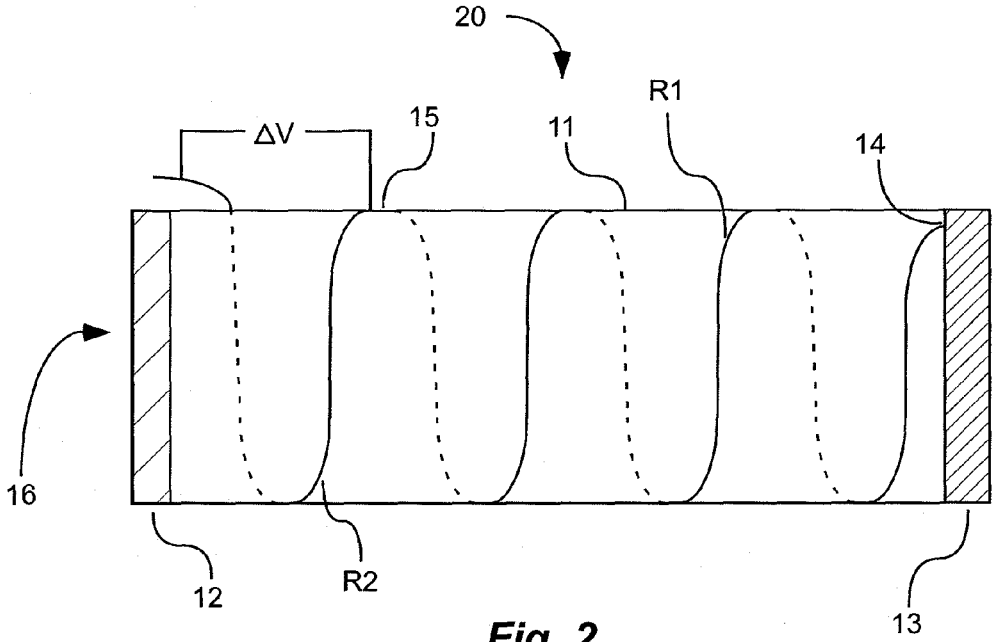
FIG. 2 is a schematic cross-sectional side view of an electrically insulative cylinder with a first resistor disposed on or over a surface of the cylinder, and circumscribing the cylinder, and a second resistor electrically connected to the first resistor and disposed on or over the surface of the cylinder, in accordance with an embodiment of the present invention.

As illustrated in FIGS. 1-2, x-ray sources 10 and 20 are shown comprising an x-ray tube 16, a first resistor R1 and a second resistor R2 electrically connected in series. The x-ray tube 16 comprises an evacuated chamber, an anode 12 disposed at one end of the evacuated chamber (see 45 in FIGS. 4 and 5), and a cathode 13 disposed at an opposing end of the evacuated chamber 45 from the anode 12. An electrically insulative cylinder 11 can at least partially surround the evacuated chamber 45. The electrically insulative cylinder 11 can circumscribe a portion of the evacuated chamber 45.

The first resistor R1 can comprise a line of electrically insulative material. The "line" can be defined as having a length L and a diameter D and wherein the length L is (1) at least 5 times longer than the diameter D in one embodiment, (2) at least 10 times longer than the diameter D in another embodiment, or at least 100 times longer than the diameter D in another embodiment.

The first resistor R1 can be disposed directly on a surface of the electrically insulative cylinder 11 in one embodiment, or disposed over a surface of the electrically insulative cylinder 11 in another embodiment. The first resistor R1 can be a dielectric ink painted on the surface of the electrically insulative cylinder 11 in one embodiment.

The first resistor R1 can be electrically connected to either the anode 12 or the cathode 13 at one end 14; and configured to be electrically connected to an external circuit at an opposing end 15. In FIGS. 1 and 2, the first resistor R1 is electrically connected to the cathode 13 at one end 14 but in FIG. 3, the first resistor R1 is electrically connected to the anode 12 at one end 14, thus showing that the first resistor R1 can be electrically connected to either the anode 12 or the cathode 13 at one end 14 in the various embodiments described herein. Normally, the first resistor R1 will be electrically connected to the cathode 13 at one end 14, in order to allow voltage measurement at a lower voltage at the opposite end 15.

The first resistor R1 can have a very large resistance r1, in order to allow sensing very large x-ray tube voltages, such as tens of kilovolts. The resistance r1 across the first resistor R1, from one end 14 to the opposite end 15, can be at least 1 mega ohm in one embodiment, at least 100 mega ohms in another embodiment, or at least 1 giga ohm in another embodiment.

As shown in FIGS. 1-2, a second resistor R2 can be connected in series with the first resistor R1. The second resistor R2 can comprise part of the external circuit. The second resistor R2 can have a resistance r2 that is much smaller than a resistance r1 of the first resistor R1. The second resistor R2 can have a resistance r2 of at least 1 kilo ohm less than a resistance r1 of the first resistor R1 in one embodiment, a resistance r2 of at least 10 mega ohms less than a resistance r1 of the first resistor R1 in another embodiment, or a resistance r2 of at least 1 giga ohm less than a resistance r1 of the first resistor R1 in another embodiment. The resistance r1 of the first resistor R1 can be at least 1000 times higher than the resistance r2 of the second resistor R2 in one embodiment, or at least 10,000 times higher than the resistance r2 of the second resistor R2 in another embodiment.

This large resistance difference, between the first resistor R1 and the second resistor R2, can allow for easier determination of overall tube voltage. It can be difficult to directly measure a voltage differential of tens of kilovolts. A voltage measurement device ΔV can be connected across the second resistor R2 and can be configured to measure a voltage across the second resistor R2. Having a second resistor R2 with a resistance r2 that is substantially smaller than a resistance r1 of the first resistor R1 allows calculation of x-ray tube voltage V by measurement of a voltage that is much smaller than x-ray tube voltage V. X-ray tube voltage V may be determined by the formula:

$$V = \frac{V_2 * (r_1 + r_2)}{r_2},$$

wherein V is a voltage across the x-ray tube, V2 is a voltage across the second resistor R2, r1 is a resistance of the first resistor R1, and r2 is a resistance of the second resistor R2.

In one embodiment, the second resistor R2 can be connected to ground 17 at one end and to the first resistor R1 at an opposing end. The external circuit can consist of the second resistor R2, ground 17, and the voltage measurement device ΔV.

As shown in FIG. 1, the second resistor R2 can be disposed partially or totally away from the electrically insulative cylinder 11, such that the second resistor R2 either does not touch the electrically insulative cylinder 11 or the second resistor R2 only partially touches the electrically insulative cylinder 11. As shown in FIG. 2, the second resistor R2 can be a line of electrically insulative material disposed on the electrically insulative cylinder 11. The second resistor R2 can be a dielectric ink painted on the surface of the electrically insulative cylinder 11.

The first resistor R1 can be any electrically insulative material that will provide the high resistance required for high voltage applications. In one embodiment, the first resistor R1 and/or the second resistor R2 can comprise beryllium oxide (BeO), also known as beryllia. Beryllium oxide can be beneficial due to its high thermal conductivity, thus providing a more uniform temperature gradient across the resistor.

As shown in FIGS. 1-2, the first resistor R1 can wrap around a circumference of the electrically insulative cylinder 11, or circumscribe the electrically insulative cylinder 11, multiple times. The first resistor R1 can wrap around a circumference of the electrically insulative cylinder 11, or circumscribe the electrically insulative cylinder 11, at least three times in one embodiment, at least five times in another embodiment, at least fifteen times in another embodiment, or at least twenty times in another embodiment.

Figure 3:
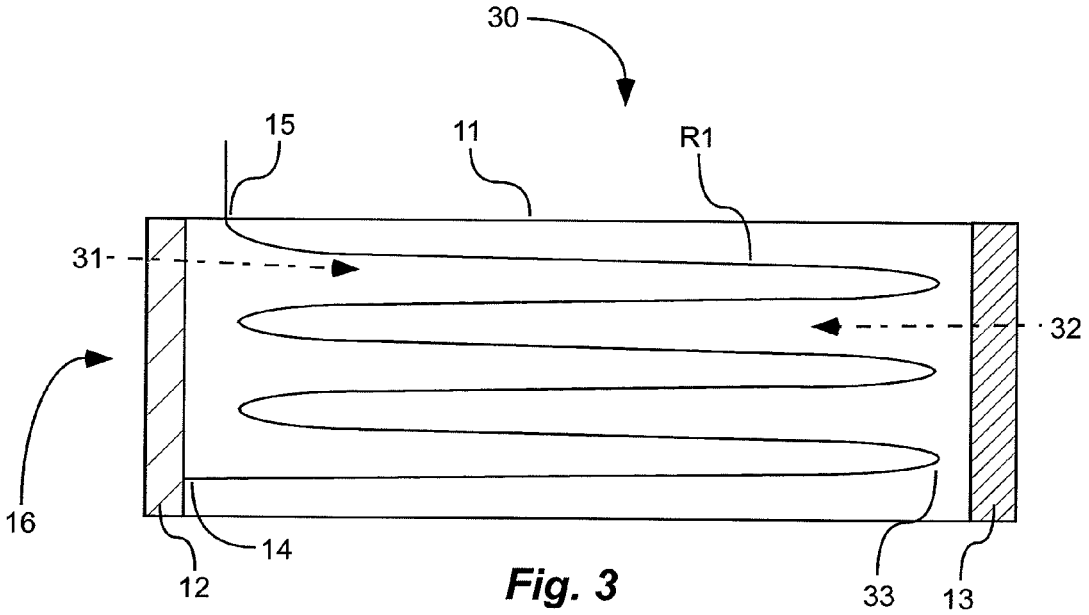
FIG. 3 is a schematic cross-sectional side view of an electrically insulative cylinder and a first resistor disposed on or over the cylinder in a zig-zag shaped pattern, in accordance with an embodiment of the present invention.

The first resistor R1 need not wrap around the electrically insulative cylinder 11 but can be disposed in any desired shape on the electrically insulative cylinder 11, as long as the desired resistance from one end to another is achieved. As shown in FIG. 3, the first resistor R1 can zig zag back and forth across a surface of the electrically insulative cylinder 11. The first resistor R1 can extends in a first direction 31, then reverse in a second direction 32 substantially opposite of the first direction 31, then reverse and extend again in the first direction 31, and repeat this reversal of direction 33 at least three more times.

Figure 4:
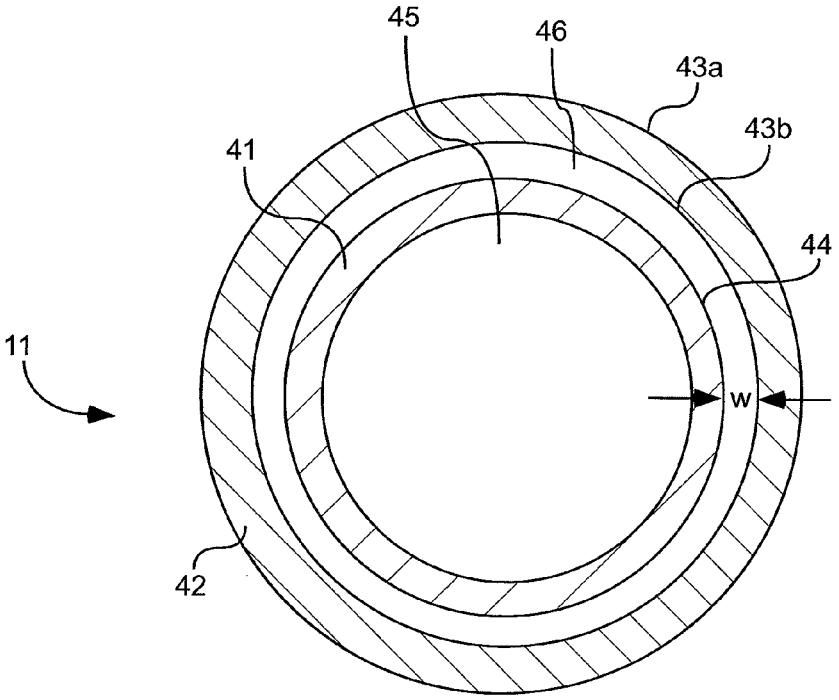
FIG. 4 is a schematic cross-sectional end view, perpendicular to the side views of FIGS. 1-3, of a first electrically insulative cylinder 41, which is surrounded at least partially by a second electrically insulative cylinder 42, in accordance with an embodiment of the present invention.

As shown in FIG. 4, the electrically insulative cylinder 11 can comprise a first electrically insulative cylinder 41 and a second electrically insulative cylinder 42. The first electrically insulative cylinder 41 can form at least a portion of the evacuated chamber 45 along with the anode 12 and the cathode 13. The first electrically insulative cylinder 41, the anode 12, and the cathode 13, can form the boundaries of and encompass the evacuated chamber 45. The second electrically insulative cylinder 42 can at least partially surround the first insulative electrically cylinder 41.

The line of insulative material can be disposed on an outer surface 44 of the first electrically insulative cylinder 41, an outer surface 43*a* of the second electrically insulative cylinder 42, or an inner surface 43*b* of the second electrically insulative cylinder 42. The first resistor R1 and/or the second resistor R2 can be a line of electrically insulative dielectric ink painted on an outer surface 44 of the first electrically insulative cylinder 41, an outer surface 43*a* of the second electrically insulative cylinder 42, or an inner surface 43*b* of the second electrically insulative cylinder 42.

There may be a gap 46 between the first electrically insulative cylinder 41 and the second electrically insulative cylinder 42. This gap 46 may be needed for ease of manufacturing or to allow insertion of insulation between the two electrically insulative cylinders 41 and 42. The gap can have a width w of between 0.5 millimeters and 5 millimeters in one embodiment. Electrically insulative potting material can substantially or completely fill the gap in one embodiment.

Figure 5:
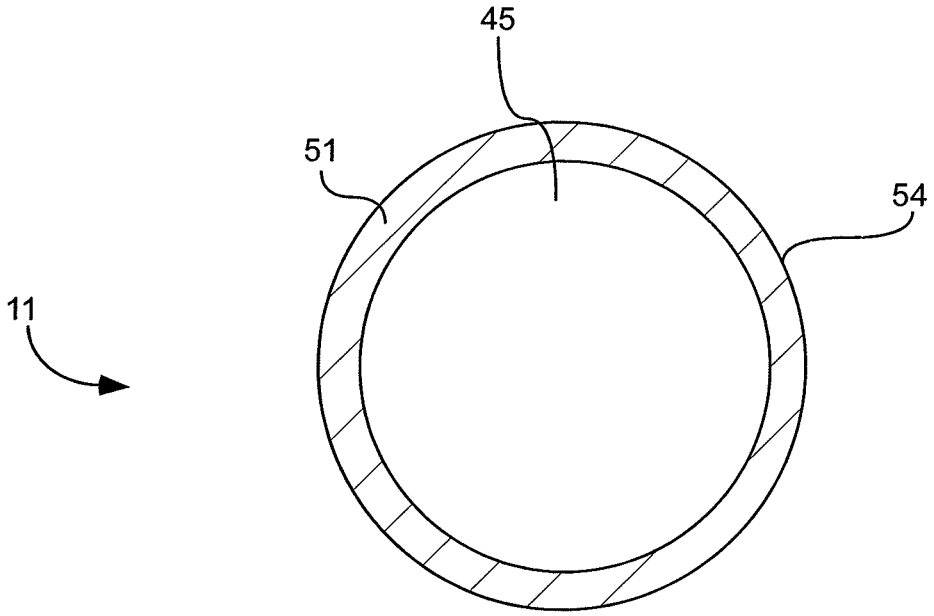
FIG. 5 is a schematic cross-sectional end view, perpendicular to the side views of FIGS. 1-3, of a single electrically insulative cylinder 51, in accordance with an embodiment of the present invention.

As shown in FIG. 5, the electrically insulative cylinder 11 can comprise a single electrically insulative cylinder 51. The single electrically insulative cylinder 51 can form at least a portion of the evacuated chamber 45 along with the anode 12 and the cathode 13. The single electrically insulative cylinder 51, the anode 12, and the cathode 13, can form the boundaries of and can encompass the evacuated chamber 45. The first resistor R1 can be disposed on an outer surface 54 of the single electrically insulative cylinder 51. The first resistor R1 can be an electrically insulative dielectric ink painted on the outer surface 54 of the single electrically insulative cylinder 51.

A single electrically insulative cylinder 51, as shown in FIG. 5, may be better for improved electron beam shaping within the x-ray tube 16, for decreased part cost, and for smaller size. Two electrically insulative cylinders 41 and 42, as shown in FIG. 4, may be better for ease of manufacturing.

MicroPen Technologies of Honeoye Falls, N.Y. has a technology for applying a thin line of electrically insulative material on the surface of a cylindrical object. Micropen's technology, or other technology for tracing a fine line of resistive material on a surface of a cylinder, may be used for applying the first resistor R1 and/or the second resistor R2 on a surface of the electrically insulative cylinder 11. The electrically insulative cylinder 11 can be turned on a lathe-like tool and the insulative material can be painted in a line on the exterior of the electrically insulative cylinder 11.

One method for sensing a voltage across an x-ray tube 16 includes painting electrically insulative material on a surface of an electrically insulative cylinder 11. The insulative material can comprise a first resistor R1. The electrically insulative cylinder 11 can surround at least a portion of an evacuated chamber 45 of an x-ray tube 16.

The method can further comprise connecting the first resistor R1 to the second resistor R2 at one end 14 and to either a cathode 13 or an anode 12 of the x-ray tube 16 at an opposing end 15, and connecting an opposing end of the second resistor R2 to ground. Then a voltage $V_2$ across the second resistor R2 can be measured. A voltage V can then be calculated across the x-ray tube 16 by:

$$V = \frac{V_2 * (r_1 + r_2)}{r_2},$$

wherein V is a voltage across the x-ray tube 16, V2 is a voltage across the second resistor R2, r1 is a resistance of the first resistor R1, and r2 is a resistance of the second resistor R2.

What is claimed is:

1. An x-ray source comprising:
a. an electrically insulative cylinder;
b. an x-ray tube comprising:
i. an evacuated chamber;
ii. an anode disposed at one end of the evacuated chamber;
iii. a cathode disposed at an opposite end of the evacuated chamber from the anode;
c. the electrically insulative cylinder circumscribing a portion of the evacuated chamber;
d. a first resistor and a second resistor electrically connected in series;
e. the first resistor:
i. comprising a line of electrically insulative dielectric ink painted on a surface of the electrically insulative cylinder;
ii. having a resistance of at least 10 mega ohms;
iii. including a first end attached to either the anode or the cathode; and
iv. including a second end electrically connected to a first end of the second resistor;
f. a resistance of the first resistor is at least 100 times higher than a resistance of the second resistor; and
g. a voltage measurement device connected across the second resistor and configured to measure a voltage across the second resistor.

2. The x-ray source of claim 1, wherein the first resistor wraps around a circumference of the electrically insulative cylinder at least five times.

3. The x-ray source of claim 1, wherein:
a. the electrically insulative cylinder comprises a single electrically insulative cylinder; and
b. the single electrically insulative cylinder forms at least a portion of the evacuated chamber along with the anode and the cathode.

4. The x-ray source of claim 1, wherein the first resistor extends in a first direction, then reverses in a second direction substantially opposite of the first direction, then reverses and extends again in the first direction, and repeats this reversal of direction at least three more times.

5. An x-ray source comprising:
a. an electrically insulative cylinder;
b. an x-ray tube comprising:
i. an evacuated chamber;
ii. an anode disposed at one end of the evacuated chamber;
iii. a cathode disposed at an opposing end of the evacuated chamber from the anode;
c. the electrically insulative cylinder at least partially surrounding the evacuated chamber; and
d. a first resistor:
i. comprising a line of electrically insulative material, having a length and a diameter and wherein the length is at least 10 times longer than the diameter;
ii. disposed directly on a surface of the electrically insulative cylinder;
iii. electrically connected to either the anode or the cathode at one end; and
iv. configured to be electrically connected to an external circuit at an opposing end.

6. The x-ray source of claim 5, wherein:
a. the electrically insulative cylinder comprises a first electrically insulative cylinder and a second electrically insulative cylinder;
b. the first electrically insulative cylinder forms at least a portion of the evacuated chamber along with the anode and the cathode;
c. the second electrically insulative cylinder at least partially surrounds the first electrically insulative cylinder; and
d. the line of electrically insulative material is disposed on a surface of the second electrically insulative cylinder.

7. The x-ray source of claim 6, wherein:
a. a gap between the first electrically insulative cylinder and the second electrically insulative cylinder is between 0.5 millimeters and 5 millimeters; and
b. electrically insulative potting material substantially fills the gap.

8. The x-ray source of claim 6, wherein the first resistor is a dielectric ink painted on the surface of the second electrically insulative cylinder.

9. The x-ray source of claim 8, wherein the line of electrically insulative material is disposed on an inside surface of the second electrically insulative cylinder.

10. The x-ray source of claim 8, wherein the line of electrically insulative material is disposed on an outside surface of the second electrically insulative cylinder.

11. The x-ray source of claim 5, wherein a resistance across the first resistor from one end to the other end is at least 10 mega ohms.

12. The x-ray source of claim 5, further comprising:

a. a second resistor connected in series with the first resistor;

b. the second resistor having a resistance of at least 1 kiloohm less than a resistance of the first resistor; and c. a voltage measurement device connected across the second resistor and configured to measure a voltage across the second resistor.

13. The x-ray source of claim 12, wherein the second resistor is a line of electrically insulative material disposed on the electrically insulative cylinder.

14. The x-ray source of claim 12, wherein the resistance of the first resistor is at least 1000 times higher than the resistance of the second resistor.

15. The x-ray source of claim 5, wherein the first resistor wraps around a circumference of the electrically insulative cylinder at least five times.

16. The x-ray source of claim 5, wherein the first resistor extends in a first direction, then reverses in a second direction substantially opposite of the first direction, then reverses and extends again in the first direction, and repeats this reversal of direction at least three more times.

17. The x-ray source of claim 5, wherein:

a. the electrically insulative cylinder comprises a single electrically insulative cylinder;

b. the single electrically insulative cylinder forms at least a portion of the evacuated chamber along with the anode and the cathode; and c. the first resistor is disposed on an outer surface of the single electrically insulative cylinder.

18. The x-ray source of claim 17, wherein the first resistor is a dielectric ink painted on the outer surface of the single electrically insulative cylinder.

19. The x-ray source of claim 5, wherein the first resistor comprises beryllium oxide.

20. A method for sensing a voltage across an x-ray tube, the method comprising:

a. painting electrically insulative material on a surface of an electrically insulative cylinder, the electrically insulative material comprising a first resistor, the electrically insulative cylinder surrounding at least a portion of an evacuated chamber of the x-ray tube;

b. connecting the first resistor to a second resistor at one end and to either a cathode or an anode of the x-ray tube at an opposing end;

c. connecting an opposing end of the second resistor to ground;

d. measuring a voltage across the second resistor; and e. calculating a voltage across the x-ray tube by $$V = \frac{V_2 * (r_1 + r_2)}{r_2},$$

wherein V is a voltage across the x-ray tube, V2 is a voltage across the second resistor, r1 is a resistance of the first resistor, and r2 is a resistance of the second resistor.

* * * * *